US007217007B2

(12) United States Patent
Choi

(10) Patent No.: US 7,217,007 B2
(45) Date of Patent: May 15, 2007

(54) DARK SKY FRIENDLY LAMP AND HOUSING COMBINATION APPARATUS

(75) Inventor: Andrew Undo Choi, Franklin Lakes, NJ (US)

(73) Assignee: Bulbrite Industries, Inc., Moonachie, NJ (US)

( * ) Notice: Subject to any disclaimer, the term of this patent is extended or adjusted under 35 U.S.C. 154(b) by 47 days.

(21) Appl. No.: 11/076,545

(22) Filed: Mar. 9, 2005

(65) Prior Publication Data

US 2006/0203499 A1 Sep. 14, 2006

(51) Int. Cl.
*F21V 17/02* (2006.01)

(52) U.S. Cl. ..... 362/282; 362/280; 362/322; 362/323

(58) Field of Classification Search ..... 362/285, 362/287, 418, 427, 216, 260, 362, 374, 375, 362/647, 649, 650, 277, 280, 319, 322, 323, 362/347, 349, 359, 360, 361
See application file for complete search history.

(56) References Cited

U.S. PATENT DOCUMENTS

| | | | | |
|---|---|---|---|---|
| 4,333,132 | A * | 6/1982 | Paley | 362/421 |
| 5,599,091 | A * | 2/1997 | Kira | 362/269 |
| 5,713,662 | A * | 2/1998 | Kira | 362/427 |
| 5,988,833 | A * | 11/1999 | Giese et al. | 362/287 |
| 6,497,501 | B1 | 12/2002 | Harder | |
| 6,783,264 | B2 * | 8/2004 | Felty | 362/371 |

* cited by examiner

*Primary Examiner*—Thomas M. Sember
(74) *Attorney, Agent, or Firm*—Reed Smith LLP; Harry K. Ahn

(57) ABSTRACT

A dark-sky friendly lamp-housing combination is provided for use with a light fixture. The combination uses a standard lamp having a light element and a base section. The base section includes a neck attached to the light element and a connector that is received in a socket of a light fixture. A housing attached to the neck is adapted to direct light from the light bulb in a predefined direction to reduce light pollution. In one aspect, the housing is rotatable about the base section so that the direction of illumination can be adjusted as desired.

12 Claims, 5 Drawing Sheets

DARK SKY FRIENDLY LAMP AND HOUSING COMBINATION APPARATUS

TECHNICAL FIELD

The present invention relates to lamps. More particularly, the present invention relates to a dark sky friendly lamp-housing combination that is designed to reduce light pollution and light trespass.

BACKGROUND OF THE INVENTION

Effective outdoor lighting benefits us in many ways. It can be used to increase pedestrian and vehicular safety, enhance a community's night time character, advertise commercial businesses and provide security. Appropriately designed and properly installed, outdoor lighting contributes to the safety and welfare of everyone. However, inappropriate outdoor lighting applications result in glare, over lighting, light escalation, sky glow and wasted energy. In many parts of the country, the beautifully star lit dark sky cannot be seen due to uncontrolled exterior lighting that results in too much light pollution.

The sources of light pollution and light trespass typically include light projected above a horizontal plane or light reflected from illuminated surfaces such as roadways. An increasing number of towns and municipalities have been involved in the alteration of the use of exterior lighting by instituting laws and ordinances. One of the "dark sky friendly™" solutions used by these towns and municipalities involves restricting the illumination direction of exterior lights. In the context of the present patent application, the phrase "dark sky friendly" means that a light illumination is directed in such a way as to reduce light pollution or light trespass or both.

Dark sky friendly lighting devices use only "good nighttime" lighting for all applications. With good nighttime lighting, everyone wins. It helps to preserve dark skies, helps people to see better at night, has a more pleasant and comfortable nighttime environment, and potentially saves a great deal of energy and money.

Several dark sky friendly luminaries (lighting fixtures) currently exist in the marketplace. The fixtures usually contain a shield within the fixture base to allow shielding of light. These fixtures can be used with any basic light bulb. However, these fixtures are often an expensive option for consumers. In many cases, the entire existing fixtures need to be replaced to make the whole lighting system dark sky friendly.

Therefore, it is desirable to provide improved inexpensive dark sky friendly lighting without the need to replace any existing fixtures.

SUMMARY OF THE DISCLOSURE

A dark sky friendly lamp-housing combination according to the present invention is provided. The combination uses a light bulb having a light element and a base section. A connector of the base section is adapted to be received in a socket of a light fixture. A housing is attached to the base section of the lamp, rather than to a light fixture, and is adapted to direct light from the light bulb.

In one embodiment, the housing is rotatably attached to the lamp base section so that the direction of illumination can be adjusted as desired.

The present invention provides an inexpensive device that can be used anywhere a standard base bulb is used. Moreover, the lamp-housing combination of the present invention allows any existing light fixture to become dark sky friendly.

DETAILED DESCRIPTION OF THE INVENTION

Figure 1:
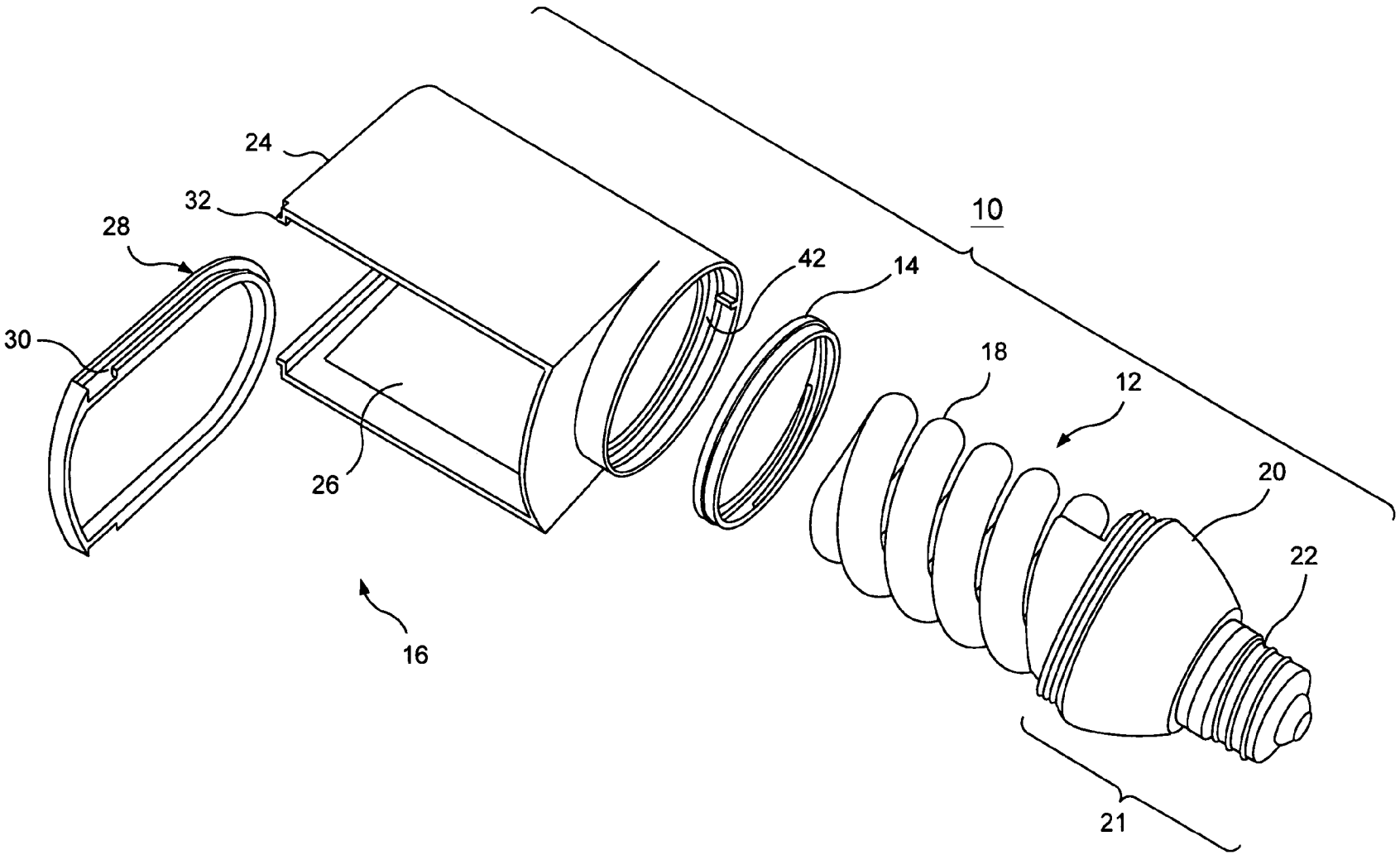
FIG. 1 illustrates a compact fluorescent lamp-housing combination in an unassembled state according to the present invention.
Figure 2:
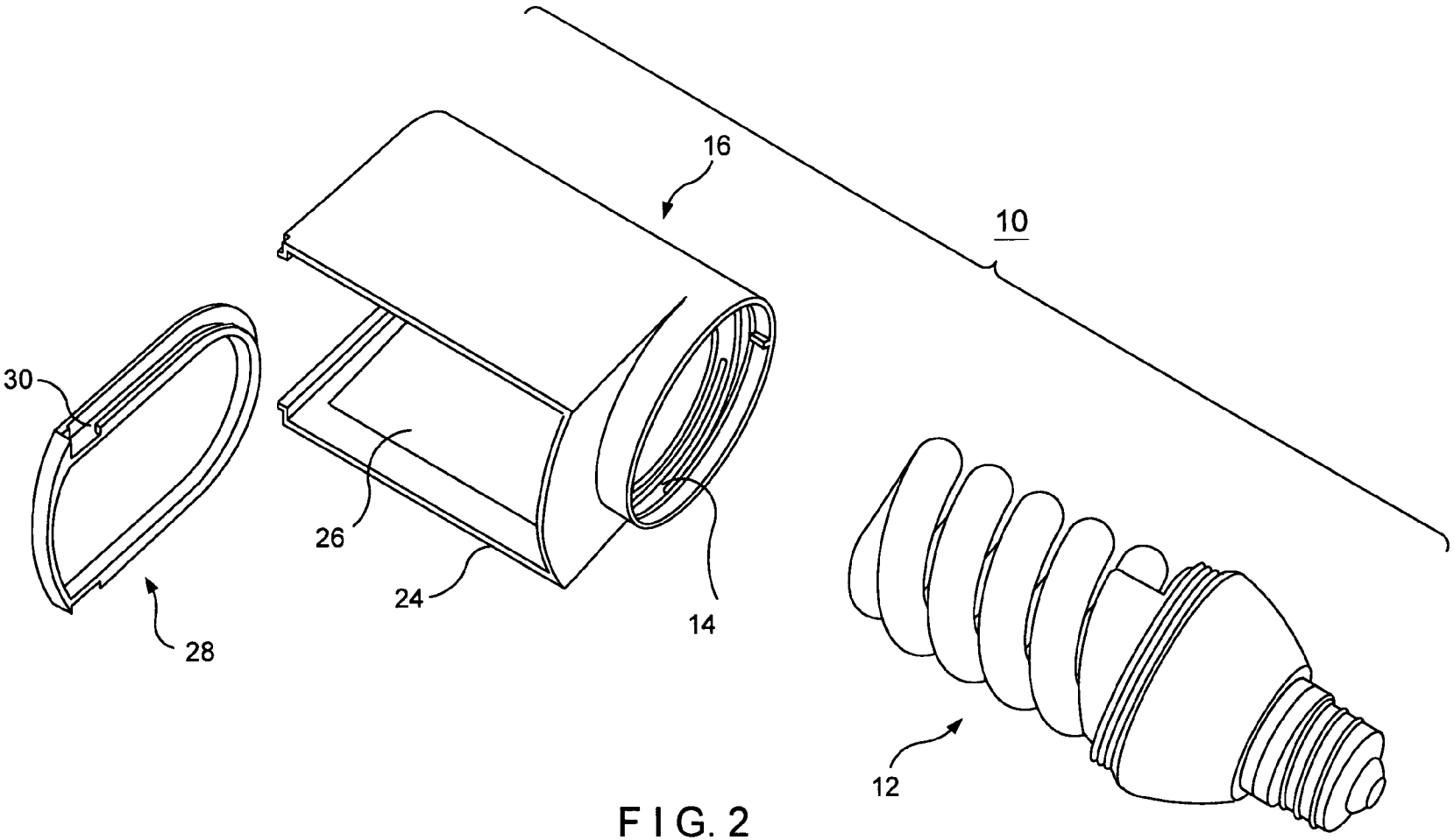
FIG. 2 illustrates the compact fluorescent lamp-housing combination of FIG. 1 with a partially assembled housing according to the present invention.

As shown in FIG. 1, a lamp-housing combination 10 includes a lamp 12, ring 14 and a rotating housing 16. Except for a threading portion, the lamp 12 shown is a standard compact fluorescent lamp having a fluorescent light element 18 and a base section 21 that includes a neck (base housing) 20 and a connector (lamp base) 22. The neck 20 is permanently attached to the connector 22 and receives the ends of the fluorescent light element 18. As is well-known, the neck 20 typically houses circuitry including a ballast through which electricity passes to produce light in the light element 18. The connector 22 is designed to electrically (through metal contacts) and physically (by the thread) be connected to a socket of a light fixture (not shown).

The housing 16 includes a U-shaped plastic shell 24, a light reflector 26 made of reflective metal and disposed on the inner wall of the shell 24, and a removable cap 28 that slides over the light element 18 to block any light in the vertical (axial) direction. If the lamp 12 is to be used in a base-down fixture, the removable cap blocks any light that projects upward. On the other hand, if the lamp 12 is to be used in a base-up fixture, the removable cap may be removed. The removable cap 28 has a groove 30 that slides over and locks with a rib 32 disposed at the top of the shell 24 to provide a tight fit. The width of the cap 28 is slightly higher than the width of the housing 26 slot so that the groove 30 and rib 32 form a friction fit or lock to prevent the cap from sliding out.

Figure 6A:
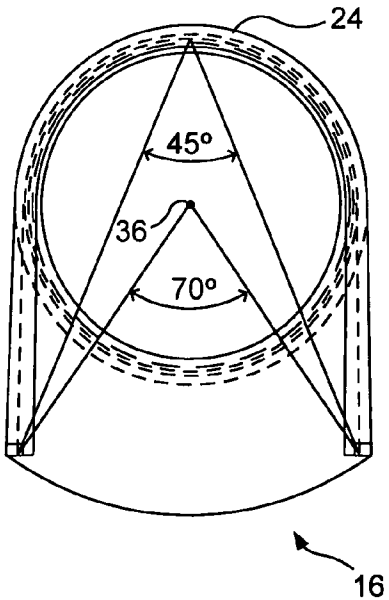
FIGS. 6A and 6B illustrate perspective and plan views of the housing of the lamp of FIG. 1 according to the present invention.
Figure 6B:
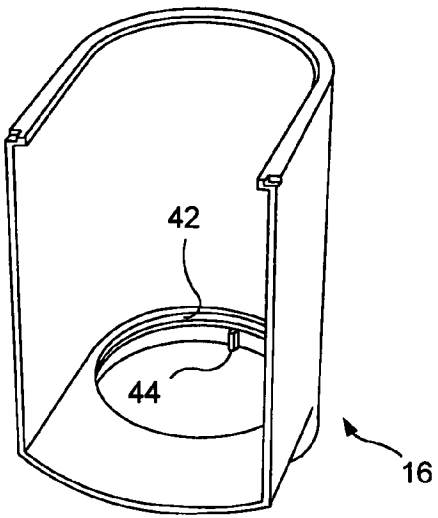

As shown in FIG. 6, the housing 16 has a lateral opening 34 that guides light illumination within a predetermined lateral range of angles. The angle range is preferably between 60 degrees and 80 degrees relative to the longitudinal axis 36 of the lamp 12. As shown in FIG. 6, the angle range is 70 degrees relative to the longitudinal axis 36 and 45 degrees relative to the backside of the housing shell 24.

Figure 5A:
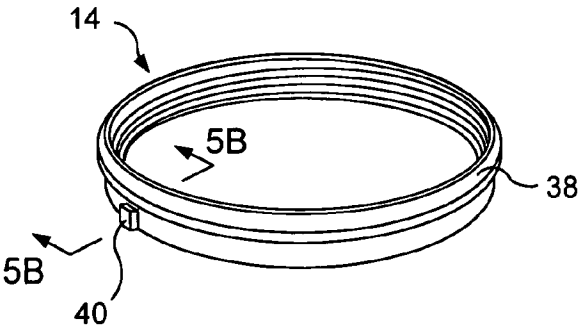
FIG. 5A illustrates a perspective view of a ring that rotationally couples the housing to the lamp of FIG. 1 according to the present invention.
Figure 5B:
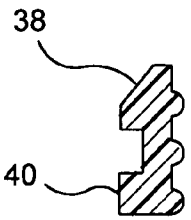
FIG. 5B is a vertical cross-sectional view of FIG. 5A along line 5A—5A according to the present invention.

The ring 14 (see FIGS. 1 and 5) has an inner threading portion that screws tightly onto the threading portion of the neck 20. Consequently, the ring 14 is threadably coupled to the neck 20 of the light bulb 12. As shown in FIG. 5, the ring 14 has a rim 38 that locks into a groove 42 of the housing shell 24 by pushing the ring toward the housing. Once the rim 38 is locked into the groove 42, the shell 24 is rotatable relative to the lamp 12. A rotation stop 40 in the outer side of the ring 14 interacts with a rotation stop 44 of the housing shell 24 to prevent the shell from rotating fully (360 degrees or more) around the lamp 12. This allows the ring 14 to be threaded into the exterior threading of the neck 20 by rotation of the housing 24. The total lengths of the rotation stops 40 and 44 define the restricted angular movement. As shown in FIGS. 5 and 6, the length of the two stops 40 and 44 corresponds to about 10 degrees relative to the longitudinal axis 36 of the lamp 12. Thus, the rotation stops 40 and 44 limit rotational movement of the housing 16 to a predefined angular range of about 350 degrees. Preferably, the predefined angular range is at least about 180 degrees. However, the lengths of the stops 40 and 44 and the number of stops can be varied to provide a desired rotational range.

Figure 3:
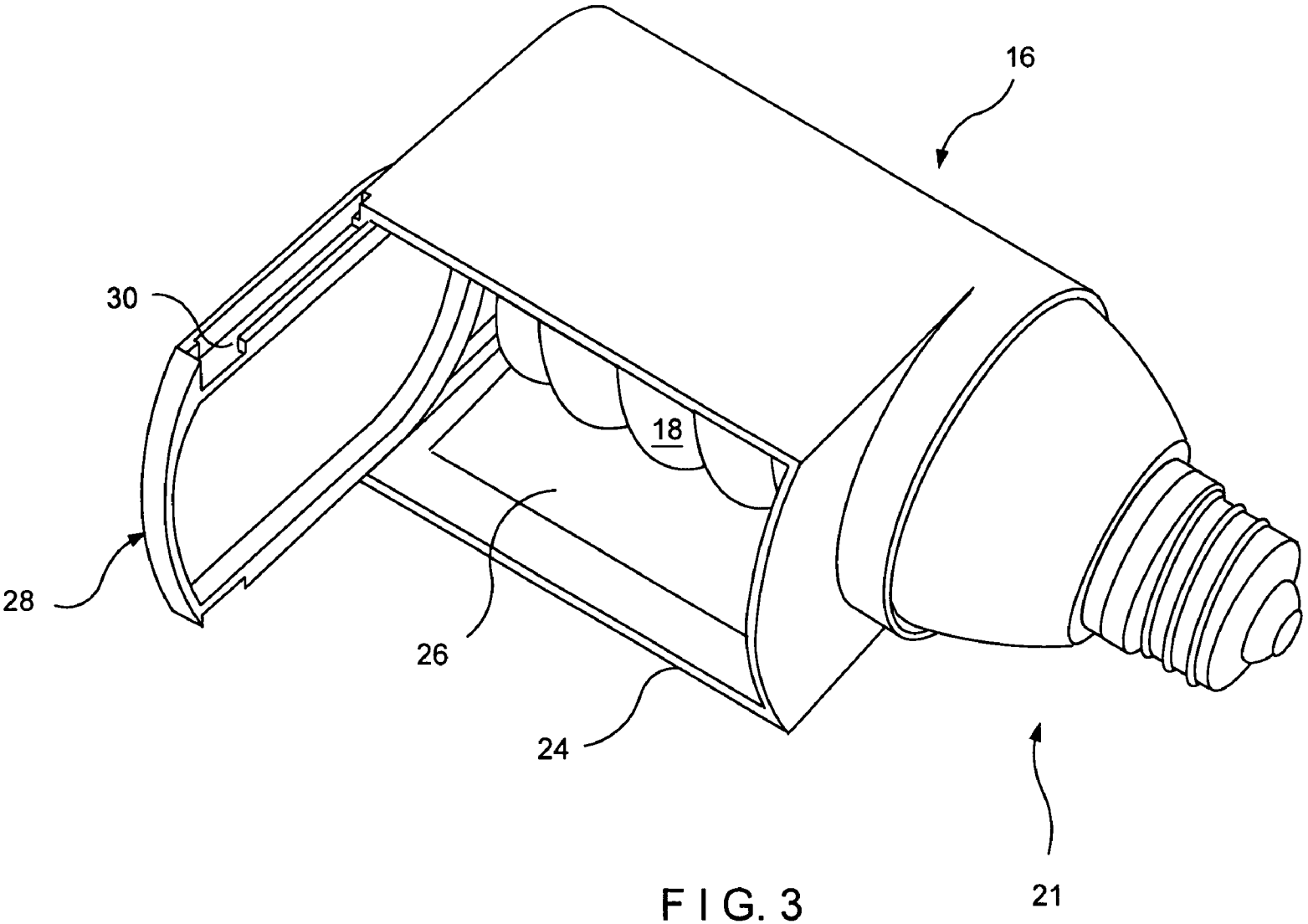
FIG. 3 illustrates the compact fluorescent lamp-housing combination of FIG. 1 in a partially assembled state according to the present invention.

Once the rim 38 of the ring 14 locks into the groove 42 of the housing shell 24, the housing is screwed onto the neck 20 of the lamp 12 through the inside threading of the ring 14. The threading of the ring 14 into the neck 20 is aided by the rotation stops 40 and 44 which prevent rotation of the housing with respect to the ring. Once the ring 14 is fully threaded into the neck 20, the ring allows the housing 16 to rotate 350 degrees in either circumferential direction. The removable cap 28, as shown in FIG. 3, is then slid into the rib 32 of the housing 16 by the groove 30 in the cap.

Figure 4A:
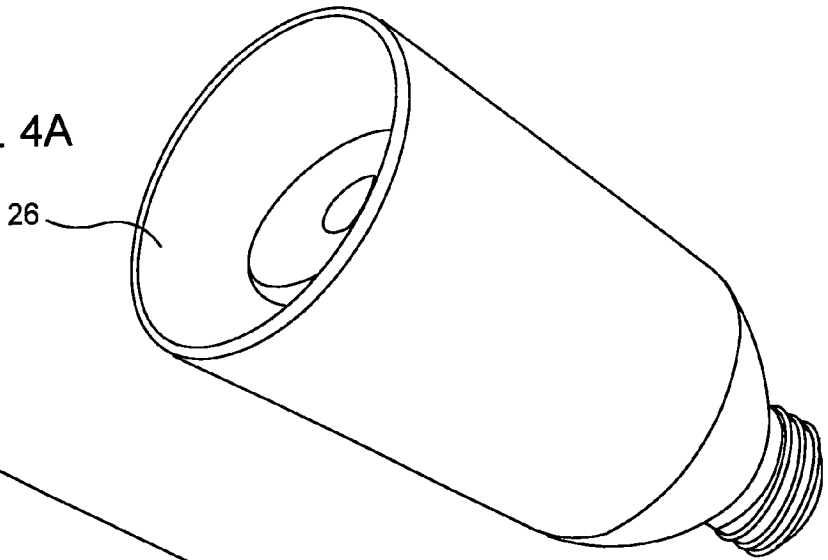
FIGS. 4A and 4B illustrate an alternative embodiment of a compact fluorescent lamp-housing combination according to the present invention.
Figure 4B:
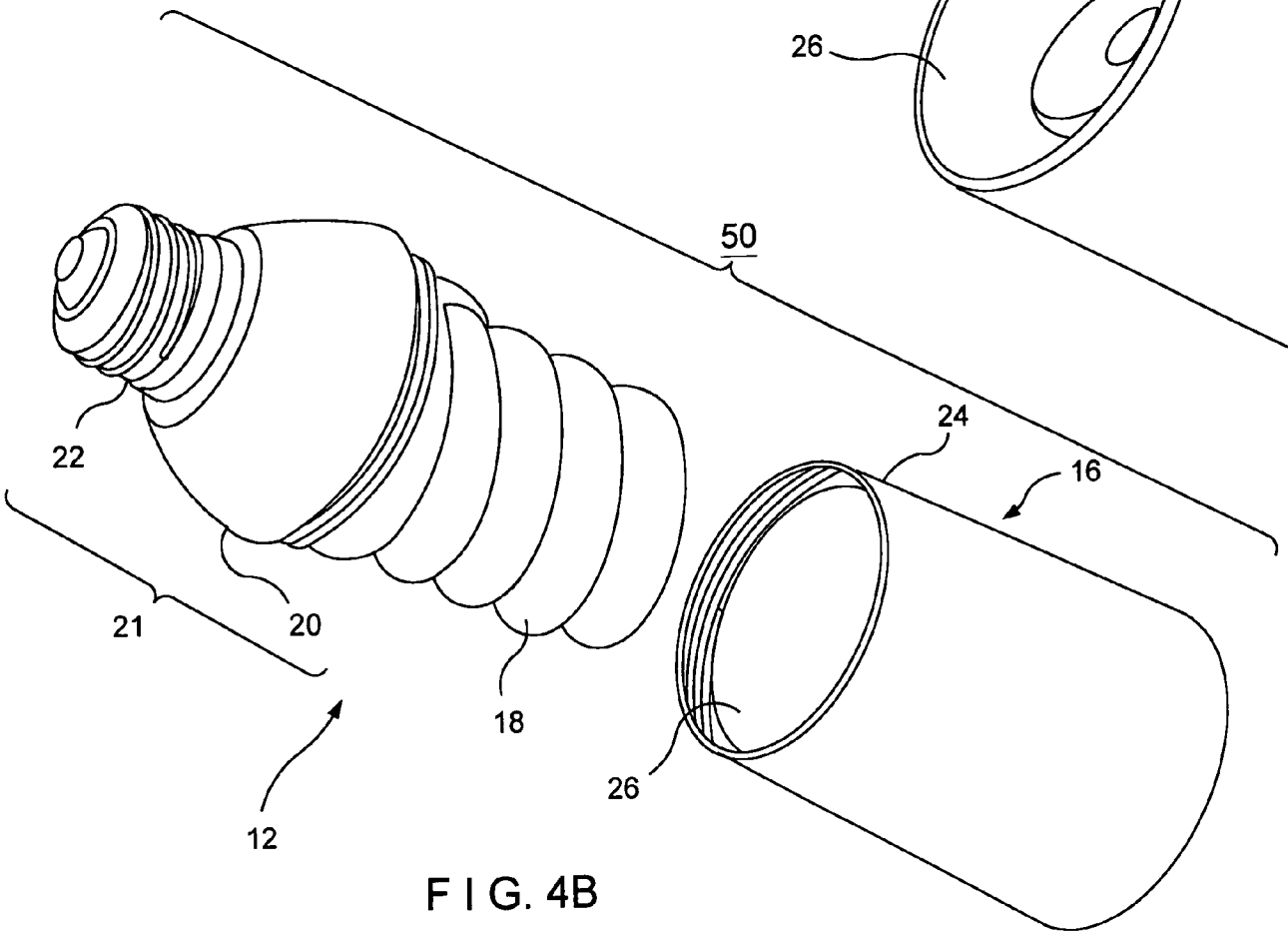

FIG. 4 illustrates an alternate embodiment of the present invention in which similar parts are identified with the same reference numerals as that of the lamp-housing combination 10 of FIG. 1. A lamp-housing combination 50 of FIG. 4 is designed to be primarily used in base-up fixtures, e.g., flood light fixture designed to direct light downwardly. A plastic cone shaped housing 16 has a light reflector 26 on the inside wall. The light reflector 26 as shown in FIG. 4 is a reflective aluminized coating. One end of the housing 16 has an inner thread that screws onto the neck 20 of the lamp 12.

According to the present invention, the housing 16 that is designed to be attached directly to the lamp 12 rather than as an add-on to a light fixture or as part of the fixture provides an inexpensive device that can be used anywhere a standard base bulb is used. Moreover, the lamp-housing combination of the present invention allows any existing light fixture to become dark sky friendly.

The foregoing specific embodiments represent just some of the ways of practicing the present invention. Many other embodiments are possible within the spirit of the invention. Accordingly, the scope of the invention is not limited to the foregoing specification, but instead is given by the appended claims along with their full range of equivalents.

What is claimed is:

1. A dark sky friendly lamp-housing combination comprising:

a lamp including:

a light element; and a base section connected to the light element and having a connector adapted to be received in a socket; and a housing rotatably attached to the base section and adapted to direct light from the light element, the housing including a removable cap disposed to block light in an axial direction of the base section; wherein the housing has an opening to direct the light out of the housing, the opening having a predetermined angular range relative to an axis of the base section.

2. The lamp-housing combination according to claim 1, wherein the housing includes:

a shell; and a reflector disposed on an inside wall of the shell.

3. The lamp-housing combination according to claim 1, wherein the predetermined angular range is between 60 degrees and 80 degrees.

4. The lamp-housing combination according to claim 1, further comprising:

a ring attached to the base section, wherein the housing includes a shell rotatably coupled to the ring for rotation about the base section.

5. The lamp-housing combination according to claim 4, wherein the base section includes a neck attached to the connector and the ring is disposed around the neck.

6. The lamp-housing combination according to claim 5, wherein the ring is threadably coupled to the neck.

7. The lamp-housing combination according to claim 4, wherein the ring includes a rotation stop that limits rotational movement of the housing to a predefined angular range relative to the base section.

8. The lamp-housing combination according to claim 7, wherein the housing includes a rotation stop adapted to cooperate with the rotation stop of the ring to limit the rotational movement of the housing.

9. A dark-sky friendly lamp-housing combination for use with a light fixture comprising:

a lamp including:

a light element;

a base section connected to the light element, the base section having:

a neck; and a connector attached to the neck and adapted to be received in a socket of a light fixture;

a housing rotatably attached to the neck and adapted to direct light from the light element;

a ring attached to the base section, wherein the housing includes a shell rotatably coupled to the ring for rotation about the base section; and wherein:

the housing includes a rotation stop; and the ring includes a rotation stop adapted to cooperate with the rotation stop of the housing to limit rotational movement of the housing to a predefined angular range relative to the base section.

10. A dark sky friendly lamp-housing combination comprising:

a lamp including:

a light element; and a base section connected to the light element and having a connector adapted to be received in a socket; and a housing rotatably attached to the base section and adapted to direct light from the light element; and a ring attached to the base section, wherein the housing includes a shell rotatably coupled to the ring for rotation about the base section, and the ring includes a rotation stop that limits rotational movement of the housing to a predefined angular range relative to the base section.

11. The lamp-housing combination according to claim 10, wherein the housing includes a rotation stop adapted to cooperate with the rotation stop of the ring to limit the rotational movement of the housing.

12. The lamp-housing combination according to claim 10, wherein:

the base section includes a neck attached to the connector and the ring is disposed around the neck; and the ring is threadably coupled to the neck.

* * * * *